United States Patent [19]

Verjux

[11] Patent Number: 4,537,205

[45] Date of Patent: Aug. 27, 1985

[54] CUTTING GUIDE FOR CIGARETTE MAKING MACHINES

[75] Inventor: Jean Verjux, Montgeron, France

[73] Assignee: Decoufle S.A.R.L., Evry, France

[21] Appl. No.: 419,911

[22] Filed: Sep. 20, 1982

[30] Foreign Application Priority Data

Mar. 9, 1982 [FR] France ..... 82 03905

[51] Int. Cl.[3] ..... A24C 5/28

[52] U.S. Cl. ..... 131/280; 83/310; 131/65; 131/84.4; 131/84.1

[58] Field of Search ..... 131/84 R, 84 C, 65; 83/310

[56] References Cited

U.S. PATENT DOCUMENTS 3,650,169 3/1972 Gianese ..... 83/310

3,772,952 11/1973 Gianese ..... 83/310

3,850,065 11/1974 Labbe et al. ..... 83/310

3,863,536 2/1975 Legardinier ..... 83/310

*Primary Examiner*—V. Millin

*Assistant Examiner*—H. Macey

[57] ABSTRACT

A cutting edge is provided of the type which are rotated about an axis perpendicular to the endless cigarette roll to be cut, at a tangential speed equal to the travelling speed of the tobacco roll, and which are constantly maintained parallel to each other.

They each comprise a fork in which is engaged a roller rotated at the same speed as it about an axis parallel to its own axis, the plane formed by the axes of rotation about themselves of the roller and of the cutting guide remaining constantly parallel to the fixed plane containing the axes about which they rotate respectively.

4 Claims, 3 Drawing Figures

CUTTING GUIDE FOR CIGARETTE MAKING MACHINES

BACKGROUND OF THE INVENTION

Cigarette making machines all comprise a cutter for cutting into sections of the length of a cigarette the endless cigarette roll which travels in front of the cutter at constant speed, which speed is moreover high in modern high yield machines.

This cutting is often obtained by passing a knife through the endless cigarette roll, said knife being driven with a rotary movement and passing orthogonally through the roll in a counter part guiding it at right angles to the cut.

The present invention relates to improvements to the cutting guides for such cigarette making machines, of the type which are rotated about an axis perpendicular to the cigarette roll to be cut, at a tangential speed equal to the travelling speed of the tobacco roll and which are constantly maintained parallel to each other.

It is known that, for the instantaneous speed of these cutting guides to be equal to that of the travelling speed of the tobacco roll, it is sufficient for them to rotate about a first axis of rotation, describing a circle of radius R such that $2\pi R = nl$, n being the number of cutting guides spaced evenly apart about the same axis of rotation, and l being the length of a cigarette.

For these cutting guides to remain constantly parallel to each other, while being rotated about said first axis of rotation, they are also able to rotate about a second axis of rotation, parallel to the first one and rotated thereabout with the cutting guides, and complementary means condition the rotation of these cutting guides about their second axis of rotation for maintaining the desired parallelism with respect to each other.

SUMMARY OF THE INVENTION

These means consist, according to the present invention, in that these cutting guides each comprise a fork in which is engaged a roller rotatable about a third axis of rotation, rotated about a fourth axis of rotation, at the same speed as that of the second axis about the first, these four axes of rotation being parallel to each other and disposed so that the eccentricity of the third axis with respect to the fourth, is the same, not only as regards the distance but also angularly, as that of the second with respect to the first.

BRIEF DESCRIPTION OF THE DRAWINGS

The accompanying drawings show by way of example one embodiment of the present invention.

DESCRIPTION OF THE PREFERRED EMBODIMENT

Figure 1:
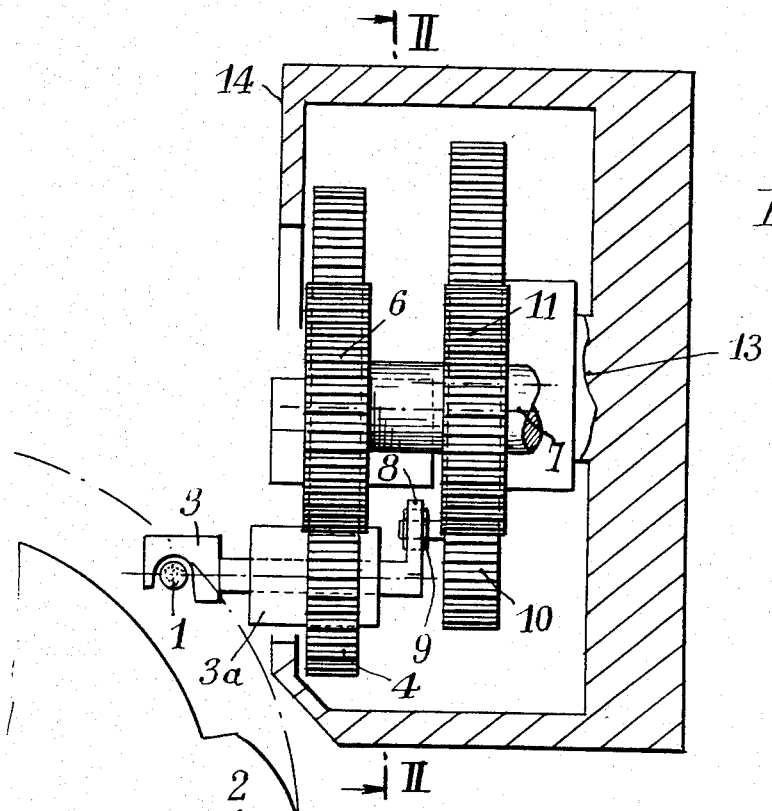
FIG. 1 is an elevational view of the mechanism for controlling the cutting guides, inside its protective casing, itself seen in section.

The continuous roll of cigarettes 1 is cut by the cutting blades 2, which pass orthogonally therethrough at high speed, while passing through the longitudinal slit which the cutting guides comprise for this purpose; these cutting guides 3, in an appropriate number n, and only one of which has been shown, are rotated by the gear-wheel 4, rotatable about the journal 5, and their axis is spaced apart from that of journal 5 by a length R such that $2\pi R = nl$, l being the length of the cigarettes to be cut.

This gear-wheel 4 meshes with a pinion 6 fixed on the drive shaft 7.

Figure 2:
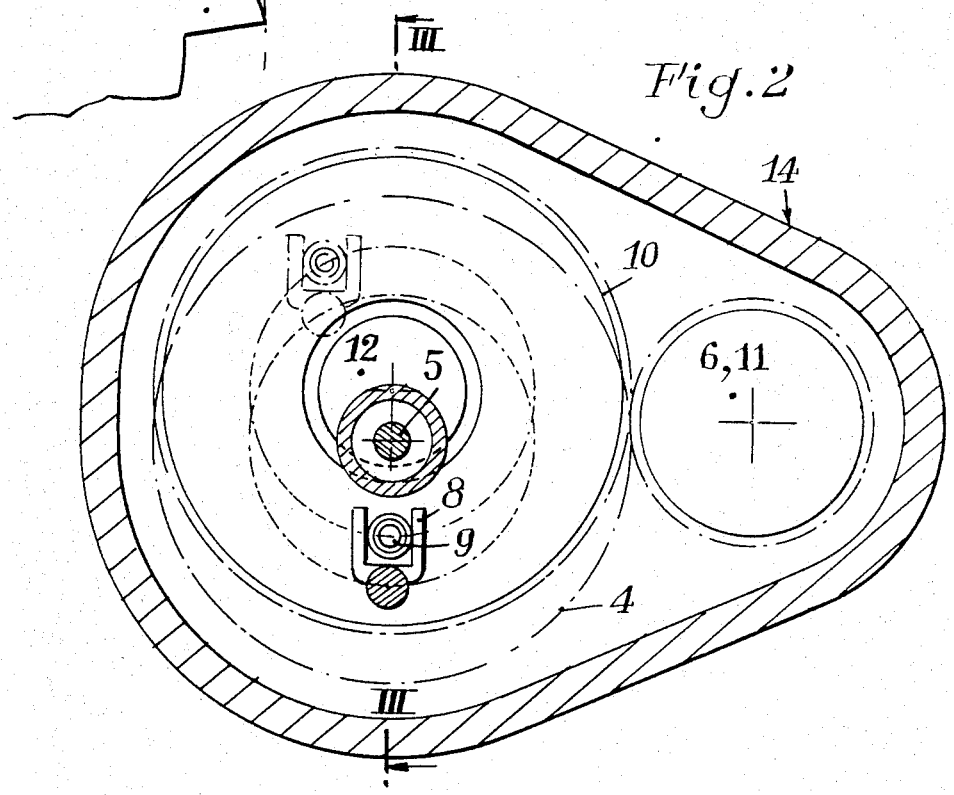
FIG. 2 is a cross sectional view along line II—II of FIG. 1.
Figure 3:
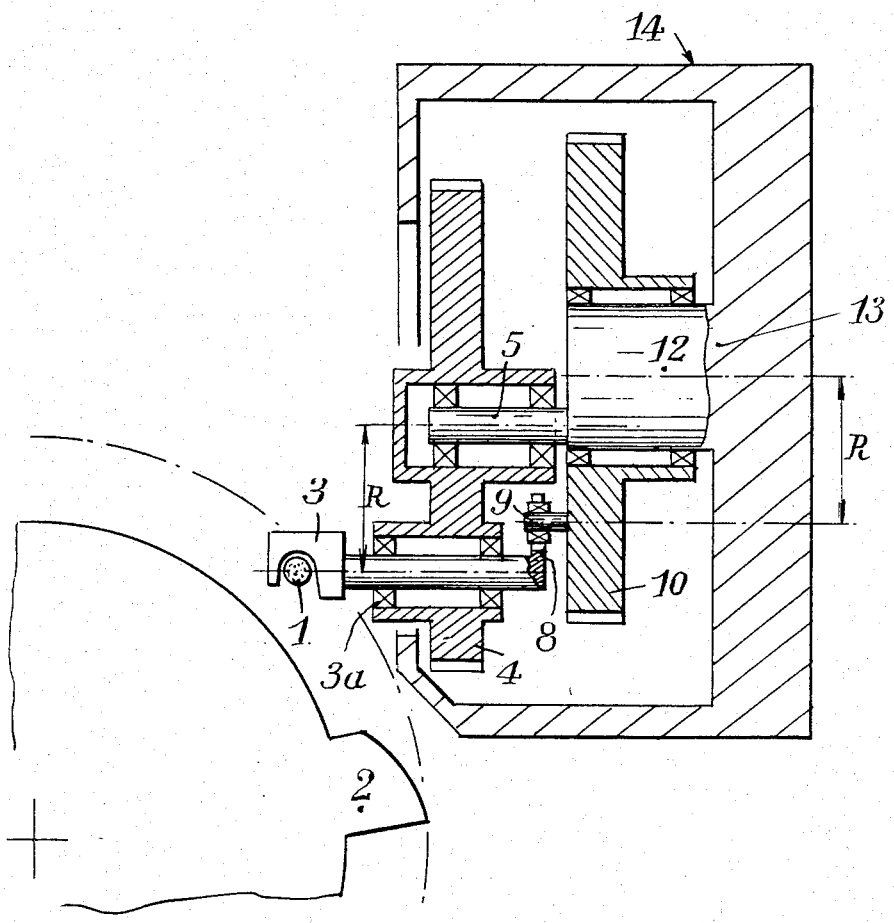
FIG. 3 is a longitudinal view in section along line III—III of FIG. 2.

Each of the cutting guides 3 is mounted freely rotatable in a bearing 3*a* of gear-wheel 4 and comprises, in its rear part, a fork 8 in which is engaged a roller 9; these rollers are mounted on a gear-wheel 10, having the same number of teeth as gear-wheel 4; gear-wheel 10 is rotated at the same speed as gear-wheel 4 by a second pinion 11, having the same number of teeth as pinion 6, and also fixed on the drive shaft 7; the eccentricity of roller 9 on gear-wheel 10 is the same as that of the cutting guides 3 on gear-wheel 4; they both rotate then at the same speed about their respective axes of rotation; these two axes of rotation are in the same vertical plane; the same goes for the axes of rotation about themselves of the cutting guides 3 and corresponding rollers 9; thus, as is shown with a dot-dash line in FIG. 2, forks 8 of each of the cutting guides 3 remain constantly parallel to each other, as well as the cutting guides which are firmly secured thereto.

Gear-wheel 10 is mounted for rotation about the cylindrical journal 12 and it has passing therethrough journal 5; both are fixed to the bottom 13 of the casing 14 for protecting the whole of the mechanism.

This mechanism for controlling the cutting guide is then particularly simple, easy to construct and reliable, without the fear of play or wear which may adversely affect correct operation thereof.

It will moreover be readily understood that the embodiment of the invention which has been described above with reference to the accompanying drawings has been given solely by way of indication and is in no wise limiting and that numerous modifications may be made without departing for all that from the scope of the present invention; thus, more particularly, the two pinions having the same number of teeth 6 and 11, fixed on the same drive shaft 7 could be provided by a single pinion meshing simultaneously with both gear-wheels 4 and 10.

What is claimed is:

1. In a cigarette making machine: a first gear wheel rotatable about a first axis; a plurality of cutting guides; a plurality of shaft means respectively rotatably supporting said guides in said gear wheel about second axes evenly distributed over said gear wheel at a distance R from said first axis such that $2\pi R = nl$, in which l is the length of the cigarettes to be cut and n the number of cutting guides; a plurality of forks respectively connected to said shaft means remote from said guides; a plurality of rollers respectively engaged in said forks; a second gear wheel arranged parallel to and of the same size as said first gear wheel and rotatable about a third axis; a plurality of shafts connected to said second gear wheel at said distance R from said third axis and respectively connected to said rollers, and means for driving said gear-wheels.

2. The combination according to claim 1, wherein said driving means include two pinions respectively meshing with said two gear wheels.

3. The combination according to claim 1, wherein said driving means includes a pinion meshing with both gear wheels.

4. The combination according to claim 1, comprising a housing, two journals fixed in said housing and respectively rotatably supporting said two gear wheels.

* * * * *